US008387418B1

(12) United States Patent
Lin et al.

(10) Patent No.: US 8,387,418 B1
(45) Date of Patent: Mar. 5, 2013

(54) YARN FEEDER FOR FLAT KNITTING MACHINES

(75) Inventors: Yu-Sheng Lin, New Taipei (TW); Yi Chen Chen, New Taipei (TW); Kai Ying Cheng, New Taipei (TW); Jian-Hao Peng, New Taipei (TW)

(73) Assignee: Pai Lung Machinery Mill Co., Ltd., New Taipei (TW)

( * ) Notice: Subject to any disclaimer, the term of this patent is extended or adjusted under 35 U.S.C. 154(b) by 0 days.

(21) Appl. No.: 13/236,334

(22) Filed: Sep. 19, 2011

(51) Int. Cl.
*D04B 15/52* (2006.01)

(52) U.S. Cl. ..... 66/126 A

(58) Field of Classification Search ..... 66/126 A, 66/127, 129, 128, 125 R, 214, 64, 133
See application file for complete search history.

(56) References Cited

U.S. PATENT DOCUMENTS

| | | | | |
|---|---|---|---|---|
| 4,738,124 | A * | 4/1988 | Stoll et al. | 66/127 |
| 5,345,789 | A * | 9/1994 | Yabuta | 66/126 A |
| 6,021,651 | A * | 2/2000 | Shima | 66/126 A |
| 6,647,749 | B2 * | 11/2003 | Ikoma | 66/126 A |
| 6,981,393 | B2 | 1/2006 | Ikoma | |
| 6,988,385 | B2 * | 1/2006 | Miyamoto | 66/127 |
| 7,096,694 | B2 * | 8/2006 | Nakamori | 66/126 A |
| 7,201,023 | B2 * | 4/2007 | Okuno et al. | 66/126 R |
| 7,272,959 | B2 * | 9/2007 | Morita et al. | 66/127 |
| 7,353,668 | B2 * | 4/2008 | Ikoma | 66/127 |
| 7,543,462 | B2 * | 6/2009 | Miyamoto | 66/126 A |

FOREIGN PATENT DOCUMENTS

EP 1788132 A1 5/2007

* cited by examiner

*Primary Examiner* — Danny Worrell
(74) *Attorney, Agent, or Firm* — Muncy, Geissler, Olds & Lowe, PLLC

(57) ABSTRACT

A yarn feeder for flat knitting machines is located on a yarn feeder guide track to move transversely thereon and includes a baseboard slidably coupled on the yarn feeder guide track, a first rocking arm, a second rocking arm and a yarn feeding unit located on the baseboard. The first and second rocking arms have respectively a first pivot end and a second pivot end coupled with the baseboard, and a first pressed end and a second pressed end to receive a horizontal force to swing respectively about the first and second pivot ends serving as fulcrums. The yarn feeding unit includes a yarn feeding arm located between the first and second rocking arms, and a first linkage bar hinged on the yarn feeding arm and first rocking arm to move simultaneously, and a second linkage bar hinged on the yarn feeding arm and second rocking arm to move simultaneously.

11 Claims, 4 Drawing Sheets

YARN FEEDER FOR FLAT KNITTING MACHINES

FIELD OF THE INVENTION

The present invention relates to a yarn feeder for flat knitting machines and particularly to a linkage type yarn feeder for flat knitting machines.

BACKGROUND OF THE INVENTION

When a conventional flat knitting machine knits a fabric, it usually employs a plurality of intarsia yarn feeders to form special intarsia on the fabric. In order to efficiently knit complicated intarsia combinations on the fabric, the flat knitting machine commonly uses computer to control movement and operation of the intarsia yarn feeders. To prevent a lower knitting needle to hook a yarn delivered through a yarn feeding aperture of the intarsia yarn feeder to generate erroneous knitting during movement of the intarsia yarn feeder or after the intarsia knitting operation is finished, design of the intarsia yarn feeder not only provides a state of supplying the yarn via the yarn feeding aperture to the knitting needle for intarsia knitting, but also includes another state of moving the yarn feeding aperture away from the aforesaid position so that the knitting needle does not hook the yarn from the yarn feeding aperture.

The conventional intarsia yarn feeder mainly adopts a swinging approach to move the yarn from the yarn feeding aperture away the knitting needle. For instance, U.S. Pat. No. 6,981,393 discloses yarn feeders of flat knitting machine that includes a yarn feeder case slidable on a yarn guide rail at the upper portion of a needle bed and a driven mechanism to selectively perform linkage movements. The yarn feeder case has a switching mechanism that can be swung to switch a yarn feeding aperture between a yarn feeding position and a waiting position. The switching mechanism also can be swung on the yarn feeder case and move a pivotal rod up and down to support the middle portion of a yarn feeding rod. The yarn feeding aperture is formed at the lower end of the yarn feeding rod while the middle portion forms a swing operating portion, and the upper end forms a pressing portion to overcome the lifting elastic force to lower the yarn feeding aperture to a yarn supply position. It further has a setting device to set lift return of the swinging operating portion. When the yarn feeding aperture is located at the yarn supply position and the yarn feeding rod is moved downwards, the swinging operating portion set by the setting device is switched to an upward direction for returning.

In addition to the aforesaid technique that adopts depressing a selected rod to swing to form skew swing of the yarn feeding rod, there are other techniques to move the yarn feeding rod, such as using a gear to drive movement of the yarn feeding rod. European patent No. EP 1788132 discloses a yarn feeder for a flat knitting machine that can be moved longitudinally along a yarn feeder guide track via a transmission pulley mounted on a triangular slide rack, and also has a yarn feeder arm movable reciprocatedly between a yarn feeding position and at least one yarn feeding stopping position. The yarn feeder has at least one adjustment element for the yarn feeder arm that has a gear acting on a second adjustment element via a pinion to adjust the movement of the yarn feeder arm.

The aforesaid conventional techniques adopt different designs to drive the yarn feeder arm. As operation of the conventional intarsia yarn feeder is complex, multiple types of adjustment elements have to be designed and assembled to swing the yarn feeder arm. Hence fabrication and assembly costs are higher. Moreover, due to adjustment elements are numerous, they are prone to generate interference among them in movements that could interrupt operation of the yarn feeder arm.

SUMMARY OF THE INVENTION

The primary object of the present invention is to overcome the problems of the conventional intarsia yarn feeders with complex design and numerous elements that result in higher costs.

To achieve the foregoing object the present invention provides a yarn feeder for flat knitting machines that is located on a yarn feeder guide track and movable transversely thereon. The yarn feeder includes a baseboard slidably coupled on the yarn feeder guide track, a first rocking arm, a second rocker arm and a yarn feeding unit that are located on the baseboard. The first rocking arm and second rocking arm have respectively a first pivot end and a second pivot end coupled with the baseboard, and a first pressed end and a second pressed end that can receive a horizontal force to swing in a skew manner respectively about the first pivot end and second pivot end serving as fulcrums. The yarn feeding unit includes a yarn feeding arm located between the first and second rocking arms, and a first linkage bar hinged on the yarn feeding arm and the first rocking arm to move simultaneously, and a second linkage bar hinged on the yarn feeding arm and the second rocking arm to move simultaneously. The yarn feeding arm has a yarn feeding position in which the first pressed end of the first rocking arm or the second pressed end of the second rocking arm is not swung, and at least one yarn feeding stopping position in which the first or second pressed end is swung by receiving a horizontal force to drive the yarn feeding arm to skew simultaneously via the first and second linkage bars.

In one embodiment the yarn feeding arm includes a guiding portion, and the baseboard has a guiding track corresponding to the guiding portion.

In one embodiment the guiding track includes two shifting sections and a retaining section between the shifting sections, and the retaining section is a concave structure.

In one embodiment the guiding portion is a guiding roller.

In one embodiment the guiding track is located on a guiding bump butted by the guiding portion.

In one embodiment the baseboard has an elastic piece, and the yarn feeding arm has a butting member pressing the elastic piece to allow the guiding portion to butt the guiding track.

In one embodiment the first pressed end includes a first switching portion, and the second pressed end includes a second switching portion, and the first and second switching portions are bridged by a linkage spring.

In one embodiment the baseboard has a first positioning bolt and a second positioning bolt, the first switching portion and second switching portion have respectively a butting surface leaning on the first and second positioning bolts when the yarn feeding arm is at the yarn feeding position, and a latching surface latching on the first and second positioning bolts when the yarn feeding arm is at the yarn feeding stopping position.

In one embodiment the yarn feeding arm has a sliding slot, and the baseboard has a fastening element inserting into the sliding slot to restrict the swinging displacement of the yarn feeding arm.

In one embodiment a cover lid is provided to couple with the baseboard to cover the first rocking arm, second rocking arm and yarn feeding unit.

The yarning feeding arm of the invention swings in a skew manner via a linkage bar structure located on the baseboard so that the yarning feeding arm can switch between the yarn feeding position and yarn feeding stopping position, and thus provides many advantages, notably:

1. Simplify the structure of driving the yarn feeding arm to form skew swing via the yarn feeder to reduce fabrication and assembly costs.

2. Eliminate interference of the structures that drive the yarn feeding arm to form the skew swing so that normal operations of elements are not affected and the probability of malfunction is reduced.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
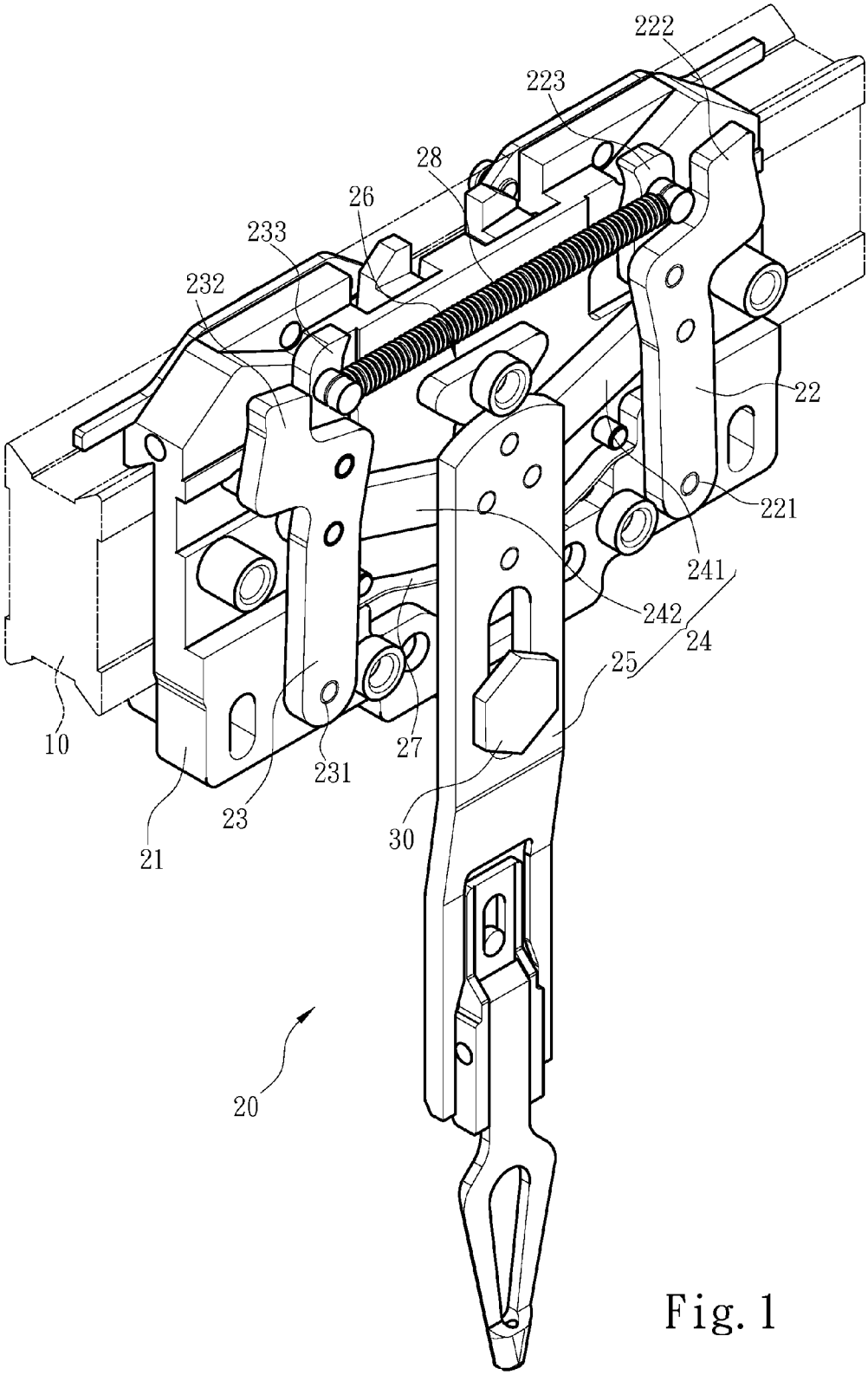
FIG. 1 is a perspective view of an embodiment of the invention.
Figure 2:
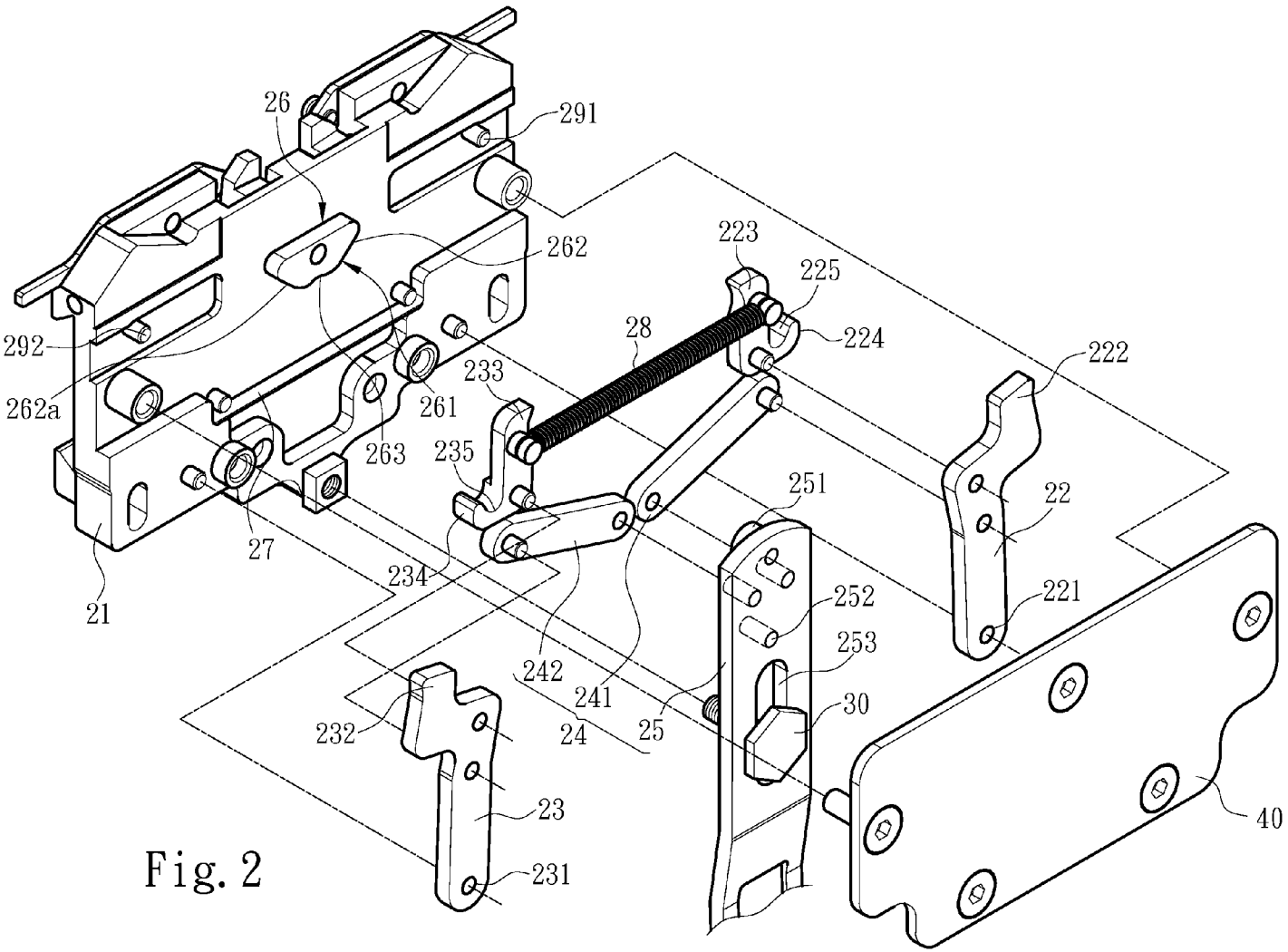
FIG. 2 is an exploded view of an embodiment of the invention.

Please refer to FIGS. 1 and 2 for an embodiment of the yarn feeder for a flat knitting machine of the invention. The flat knitting machine includes at least a yarn feeder guide track 10 to allow a yarn feeder 20 to move transversely by sliding to a position where yarn feeding is performed. The yarn feeder 20 mainly includes a baseboard 21 slidably coupled on the yarn feeder guide track 10, a first rocking arm 22, a second rocking arm 23 and a yarn feeding unit 24 that are located on the baseboard 21. The first rocking arm 22 has a first pivot end 221 coupled with the baseboard 21 and a first pressed end 222 to receive a horizontal force to swing about the first pivot end 221 serving as a fulcrum. The second rocking arm 23 has a second pivot end 231 coupled with the baseboard 21 and a second pressed end 232 to receive another horizontal force to swing about the second pivot end 231 serving as a fulcrum. The yarn feeding unit 24 includes a yarn feeding arm 25 located between the first and second rocking arms 22 and 23, and a first linkage bar 241 hinged on the yarn feeding arm 25 and the first rocking arm 22 to move simultaneously, and a second linkage bar 242 hinged on the yarn feeding arm 25 and the second rocking arm 23 to move simultaneously. The yarn feeding arm 25 has a yarn feeding position in which the first pressed end 222 of the first rocking arm 22 or second pressed end 232 of the second rocking arm 23 is not swung, and at least one yarn feeding stopping position in which the first or second pressed end 222 or 232 is swung by receiving a horizontal force to drive the yarn feeding arm 25 to skew via the first and second linkage bars 241 and 242. The yarn feeding arm 25 has a sliding slot 253. The baseboard 21 has a fastening element 30 inserting into the sliding slot 253 to limit the swinging displacement of the yarn feeding arm 25. The yarn feeding arm 25 swings about the fastening element 30 serving as a fulcrum between the yarn feeding position and yarn feeding stopping position.

In order to make the yarn feeding arm 25 to move steadily between the yarn feeding position and yarn feeding stopping position, the yarn feeding arm 25 has a guiding portion 251, and the baseboard 21 has a guiding bump 26 corresponding to and butted by the guiding portion 251. The guiding bump 26 has a guiding track 261 to guide the guiding portion 251 to move correspondingly. The guiding track 261 includes two shifting sections 262 and 262*a* and a retaining section 263 located therebetween and formed in a concave structure. In this embodiment, the guiding portion 251 is a guiding roller movable along the guiding track 261 and between the shifting sections 262 and 262*a* and retaining section 263. In addition, the baseboard 21 has an elastic piece 27, and the yarn feeding arm 25 has a butting member 252 butting the elastic piece 27 to provide a pressing force for the guiding portion 251 to butt against the guiding track 261.

The first pressed end 222 has a first switching portion 223, and the second pressed end 232 has a second switching portion 233. The first and second switching portions 223 and 233 are bridged by a linkage spring 28. The first switching portion 223 and second switching portion 233 have respectively a butting surface 224 and 234, and a latching surface 225 and 235. The baseboard 21 has a first positioning bolt 281 and a second positioning bolt 292 located outside the first switching portion 223 and second switching portion 233. When the yarn feeding arm 25 is at the yarn feeding position, the butting surfaces 224 and 234 of the first and second switching portions 223 and 233 lean on the first and second positioning bolts 291 and 292 at the same time. When the yarn feeding arm 25 is at the yarn feeding stopping position, the latching surface 225 or 235 of the first or second switching portion 223 or 233 latches on the first positioning bolt 291 or second positioning bolt 292.

To protect the first rocking arm 22, second rocking arm 23 and yarn feeding unit 24, the yarn feeder 20 further has a cover lid 40 to couple with the baseboard 21 to cover the first rocking arm 22, second rocking arm 23 and yarn feeding unit 24 as shown in FIG. 2.

Figure 3A:
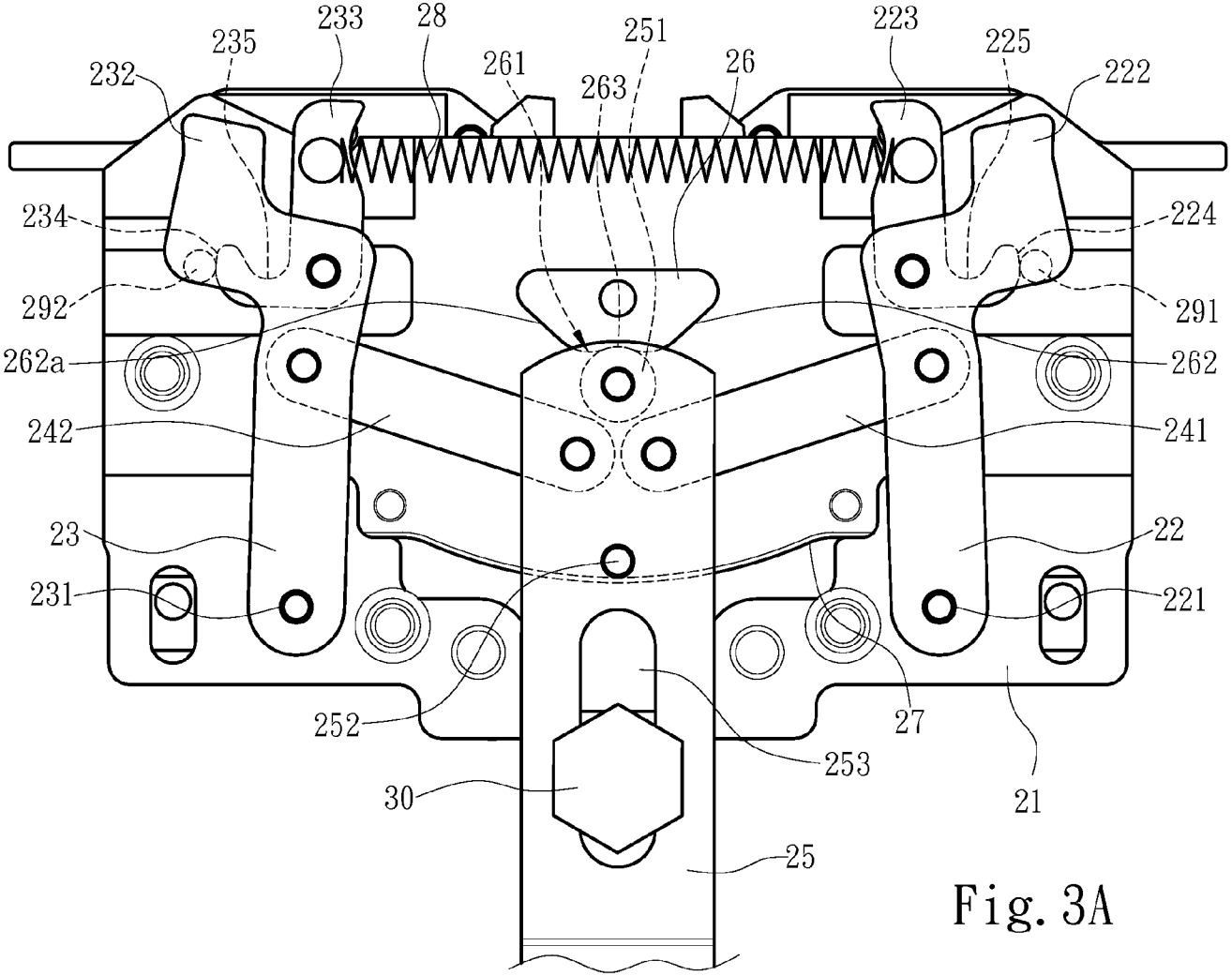
FIGS. 3A and 3B are schematic views of an embodiment of the invention in operating conditions.
Figure 3B:
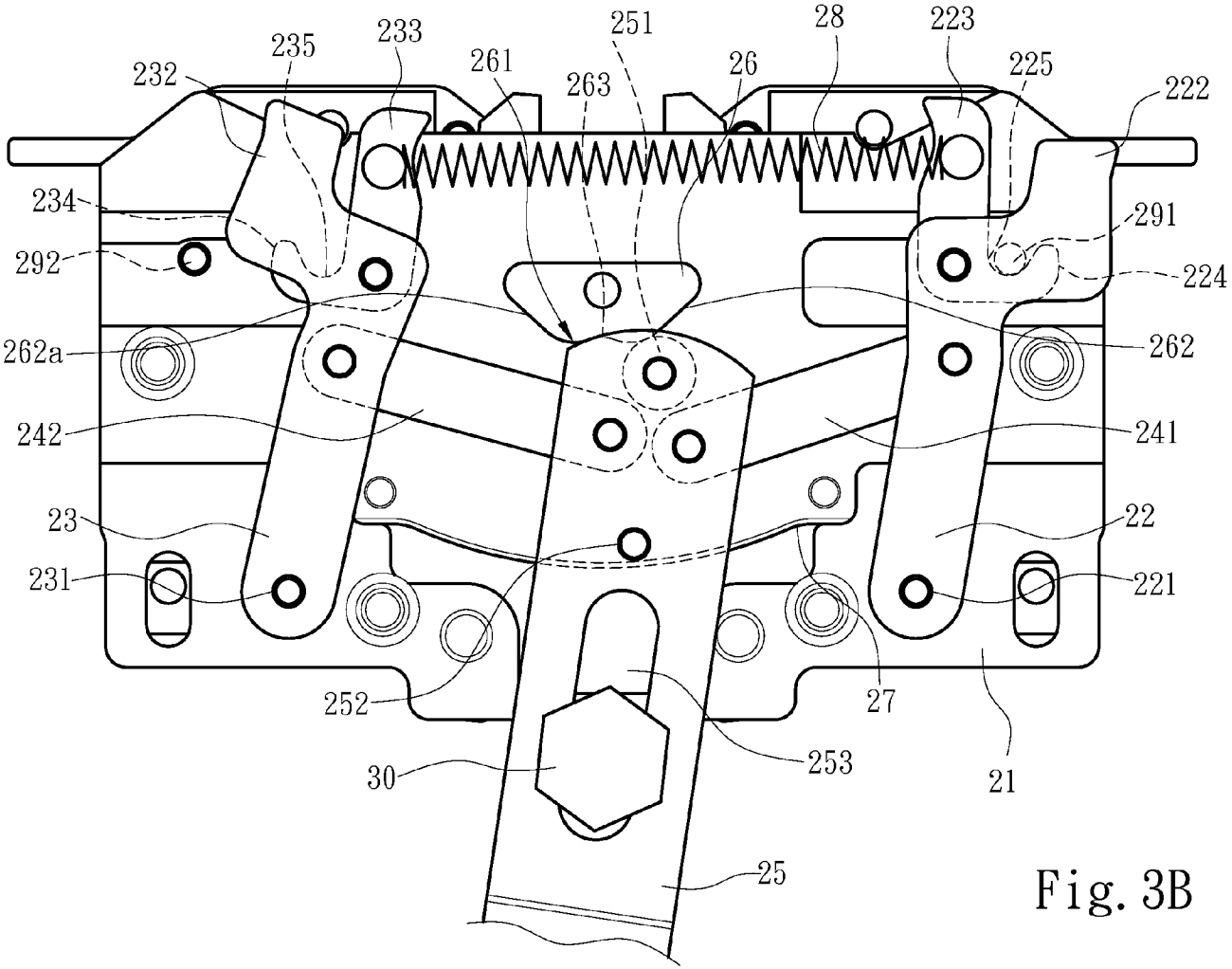

Please refer to FIGS. 3A and 3B for an embodiment of the invention in operating conditions. When the first and second pressed ends 222 and 232 of the first and second rocking arms 22 and 23 do not respectively receive a horizontal force from a switch bar (not shown in the drawings) of the flat knitting machine, the first and second switching portions 223 and 233 of the first and second rocking arms 22 and 23 butt the first positioning bolt 291 and second positioning bolt 292 via the butting surfaces 224 and 234 so that the yarn feeding arm 25 remains at the yarn feeding position (referring to FIG. 3A). Meanwhile, the elastic piece 27 provides a pressing force for the butting member 252, and the guiding portion 251 butts the retaining section 263 to be positioned therein temporarily. When the first or second switching portion 223 or 233 of the first or second rocking arm 22 or 23 is driven by the switch bar (not shown in the drawings), the first switching portion 223 swings relative to the first pressed end 222 or the second switching portion 233 swings relative to the second pressed end 232, and also moves towards the first positioning bolt 291 or second positioning bolt 292, and then the first positioning bolt 291 or second positioning bolt 292 enters from the original position at the butting surface 224 or 234 to the latching surface 225 or 235 of the first or second switching portion 223 or 233 to form a latching state, thereby drives the first rocking arm 22 and second rocking arm 23 to swing in a skew manner. Meanwhile, the yarn feeding arm 25 coupled with the first and second rocking arms 22 and 23 also swing correspondingly via the first and second linkage bars 241 and 242 to switch from the yarn feeding position to the yarn feeding stopping position shown in FIG. 3B. In such a condition, the guiding portion 251 of the yarn feeding arm 25 escapes from the concave structure of the retaining section 263 and enters the shifting section 262 or 262*a*. In this embodiment, the shifting sections 262 and 262*a* are inclined to allow the yarn feeding arm 25 to swing about the fastening element 30 serving as a fulcrum in a skew manner at the yarn feeding stopping position. To return the yarn feeding arm 25 to the yarn feeding position, the switch bar (not shown in the drawings) provides a counter horizontal force to the first or second pressed end 222 or 232 to swing the first or second rocking arm 22 or 23 in the opposite direction, and also drive the first and second linkage bars 241 and 242 to return the yarn feeding arm 25 to the yarn feeding position.

As a conclusion, the yarn feeder of the invention employs a linkage bar system to swing the yarn feeding arm between the yarn feeding position and yarn feeding stopping position. Compared with the conventional intarsia yarn feeder, the invention provides a simpler structure, and can reduce production and assembly costs. Moreover, interference among elements to drive the yarn feeding arm swinging also is eliminated, hence the probability of malfunction also decreases. It provides a significant improvement over the conventional techniques.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A yarn feeder for flat knitting machines located on a yarn feeder guide track and movable transversely thereon, comprising:

a baseboard slidably coupled on the yarn feeder guide track;

a first rocking arm and a second rocking arm including respectively a first pivot end and a second pivot end coupled with the baseboard and a first pressed end and a second pressed end to receive a horizontal force to swing respectively in a skew manner about the first pivot end and the second pivot end serving as fulcrums; and a yarn feeding unit including a yarn feeding arm located between the first rocking arm and the second rocking arm and a first linkage bar hinged on the yarn feeding arm and the first rocking arm to move simultaneously and a second linkage bar hinged on the yarn feeding arm and the second rocking arm to move simultaneously, the yarn feeding arm including a yarn feeding position in which the first pressed end or the second pressed end is not swung and at least one yarn feeding stopping position in which the first pressed end or the second pressed end is swung by receiving the horizontal force to drive the yarn feeding arm to skew simultaneously via the first linkage bar and the second linkage bar.

2. The yarn feeder for flat knitting machines of claim 1, wherein the yarn feeding arm includes a guiding portion, the baseboard including a guiding track corresponding to the guiding portion.

3. The yarn feeder for flat knitting machines of claim 2, wherein the guiding track includes two shifting sections and a retaining section located therebetween.

4. The yarn feeder for flat knitting machines of claim 3, wherein the retaining section is a concave structure.

5. The yarn feeder for flat knitting machines of claim 2, wherein the guiding portion is a guiding roller.

6. The yarn feeder for flat knitting machines of claim 2, wherein the guiding track is located on a guiding bump butted by the guiding portion.

7. The yarn feeder for flat knitting machines of claim 2, wherein the baseboard includes an elastic piece, the yarn feeding arm including a butting member pressing the elastic piece to allow the guiding portion to butt the guiding track.

8. The yarn feeder for flat knitting machines of claim 1, wherein the first pressed end includes a first switching portion and the second pressed end includes a second switching portion, the first switching portion and the second switching position being bridged by a linkage spring.

9. The yarn feeder for flat knitting machines of claim 8, wherein the baseboard includes a first positioning bolt and a second positioning bolt, the first switching portion and the second switching portion including respectively a butting surface leaning on the first positioning bolt and the second positioning bolt when the yarn feeding arm is at the yarn feeding position, and a latching surface latching on the first positioning bolt and the second positioning bolt when the yarn feeding arm is at the yarn feeding stopping position.

10. The yarn feeder for flat knitting machines of claim 1, wherein the yarn feeding arm includes a sliding slot and the baseboard includes a fastening element inserting into the sliding slot to limit swinging displacement of the yarn feeding arm.

11. The yarn feeder for flat knitting machines of claim 1 further including a cover lid coupled with the baseboard to cover the first rocking arm, the second rocking arm and the yarn feeding unit.

* * * * *